US011452330B1

(12) United States Patent
Nasibyan et al.

(10) Patent No.: US 11,452,330 B1
(45) Date of Patent: Sep. 27, 2022

(54) DYNAMIC ORTHOTIC DEVICE

(71) Applicants: Tigran Nasibyan, Erie, PA (US); Alena Nasibyan, Erie, PA (US)

(72) Inventors: Tigran Nasibyan, Erie, PA (US); Alena Nasibyan, Erie, PA (US)

( * ) Notice: Subject to any disclaimer, the term of this patent is extended or adjusted under 35 U.S.C. 154(b) by 398 days.

(21) Appl. No.: 16/865,328

(22) Filed: May 2, 2020

(51) Int. Cl.
*A43B 7/1455* (2022.01)
*A61H 15/00* (2006.01)

(52) U.S. Cl.
CPC ..... *A43B 7/146* (2013.01); *A61H 15/00* (2013.01); *A61H 2015/0042* (2013.01); *A61H 2015/0064* (2013.01); *A61H 2205/12* (2013.01)

(58) Field of Classification Search
CPC ..... A61H 15/00; A61H 2015/0042; A61H 2015/0064; A61H 2201/1676; A61H 2201/1284; A61H 2201/1269; A61H 2201/1261; A61H 2201/1253; A61H 2205/12; A43B 7/146; A43B 3/42
See application file for complete search history.

(56) References Cited

U.S. PATENT DOCUMENTS 5,868,688 A * 2/1999 Avidor ..... A61H 7/004 601/102
10,492,980 B2 * 12/2019 Giraud ..... A61H 15/0085
2010/0069800 A1 * 3/2010 Hsu ..... A61H 15/02 601/115
2010/0081973 A1 * 4/2010 Tsai ..... A61H 15/0078 601/134
2010/0179460 A1 * 7/2010 Tsai ..... A61H 15/0078 601/134
2010/0280426 A1 * 11/2010 Tsai ..... A61H 15/0078 601/134
2014/0276277 A1 * 9/2014 Chen ..... A61H 7/007 601/112
2019/0321259 A1 * 10/2019 Zhou ..... A61H 7/007
2020/0352274 A1 * 11/2020 Naiker ..... A43B 3/35

* cited by examiner

*Primary Examiner* — Colin W Stuart
*Assistant Examiner* — Douglas Y Sul
(74) *Attorney, Agent, or Firm* — Richard K Thomson

(57) ABSTRACT

A dynamic orthotic device has a pair of rotating disks which are received in a base. Each disk houses a plurality of spherical foot-massaging balls. Each of the pair of disks is activated by a spring-biased pushbutton with arms mounted to a bottom edge of the pushbutton, each arm having a tine which engages a gear-toothed member affixed to the respective rotating disk and rotates them in opposite rotational directions. The massaging balls engage the soles of the wearer's feet in different locations with each respective step eliminating pressure buildup on the heels of the wearer.

1 Claim, 4 Drawing Sheets

DYNAMIC ORTHOTIC DEVICE

BACKGROUND AND SUMMARY OF THE INVENTION

The present invention is directed to the field of orthotics. More particularly, the present invention is directed to a dynamic orthotic device.

As a rule, orthotic devices are static, that is, there is no significant movement, (with some exceptions in cases where the device itself is flexible) and, accordingly, the heel/foot sees the same pressure in the same place with each successive step. This means that the exertion of pressure on the same spot can produce a "pressure overload" leading/contributing to planters faciitis and other related foot problems which, typically, orthotics nominally, are supposed to remedy.

It is among the objects of this invention to provide the first truly dynamic orthotic device in which the pressure administration point ("pressure point") changes with each step thereby eliminating the pressure buildup that can take place with walking or other forms of exercise. Indeed, with the current dynamic orthotic device, a slight heel-toe rocking motion while standing can produce the desired change in the pressure point providing a "foot massage" as the heel-toe rocking motion activates the dynamic orthotic device.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
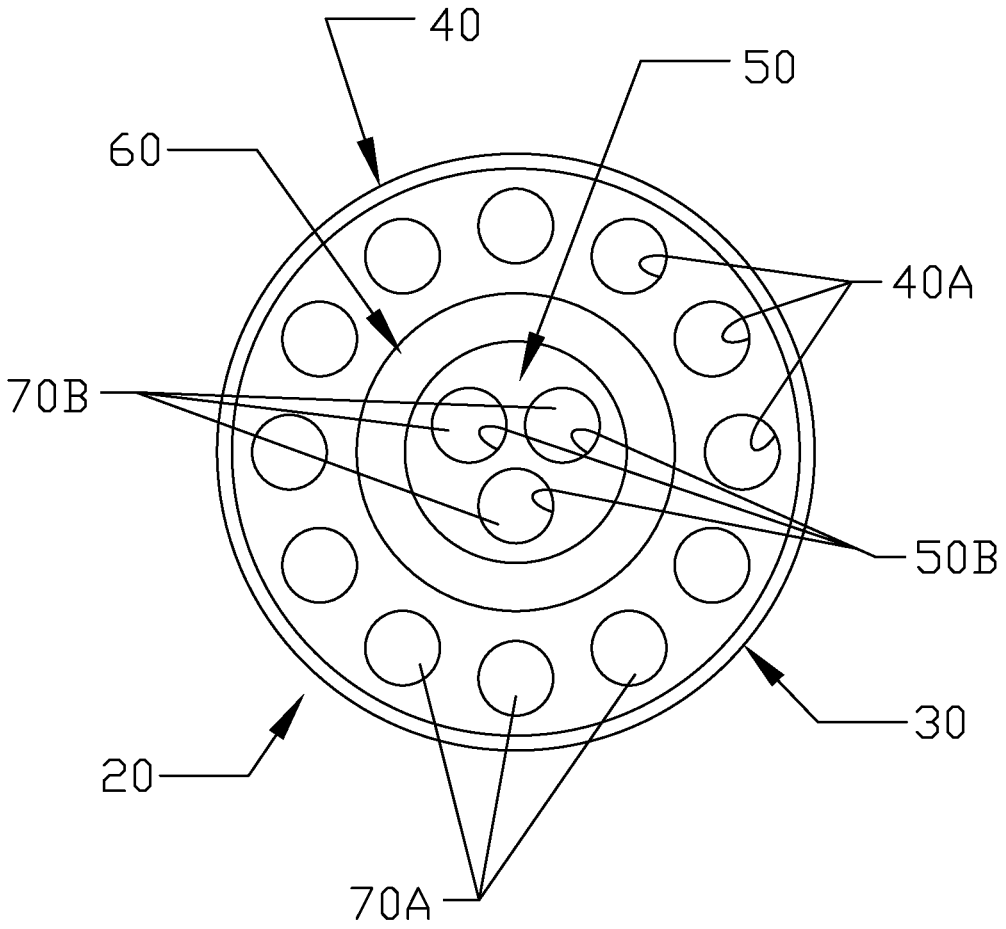
FIG. 1 is a top view of a first embodiment of the dynamic orthotic device of the present invention.
Figure 2:
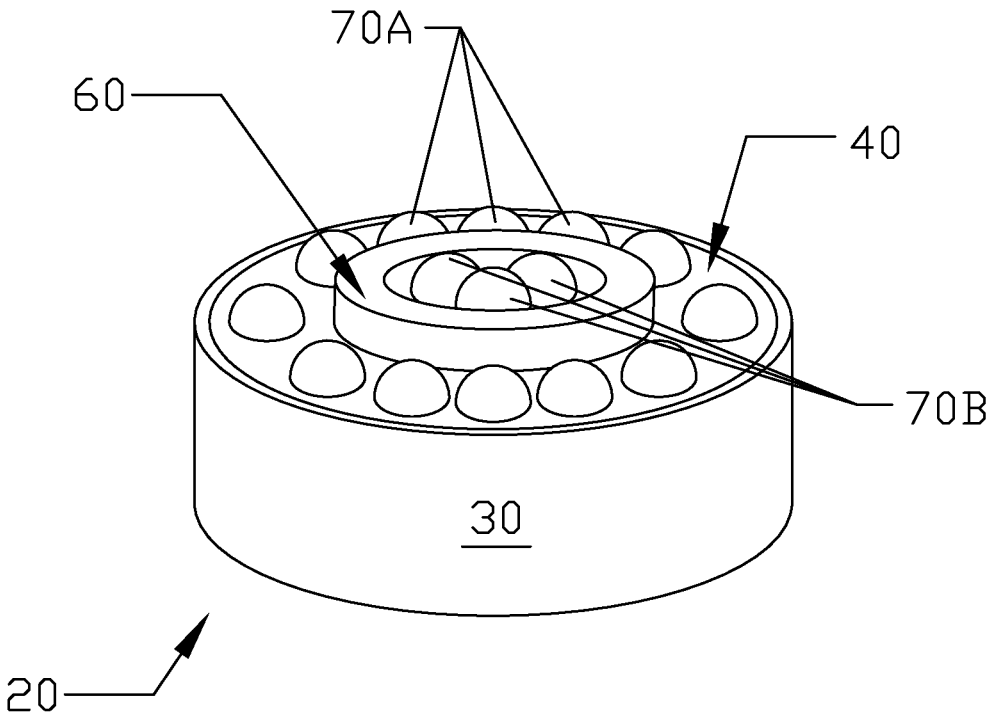
FIG. 2 is a front perspective view of the first embodiment.

A first embodiment of the dynamic orthotic device of the present invention is depicted in FIGS. 1-4 generally at 20. Dynamic orthotic device 20 comprises a base 30, outer rotating disk 40, inner rotating disk 50 pushbutton 60 and a plurality of massaging balls 70. The plurality of massaging balls 70 are grouped in two subsets: 70A and 70B. Each ball of subset 70A is received in one of the holes 40A in outer rotating disk 40 and each of the balls of subset 70B is received in one of the holes 50B in inner rotating disk 50. Although each of the holes 40A and 50B are depicted as being larger than the diameter of its respective ball, it is among the features of the present invention that those holes can be smaller than the diameter of the ball while the distance between the support 54 of base 30 beneath outer rotating disk 40 and the disk 40 itself is larger than ½ the diameter of balls 70B as is the distance between support surface 52 and inner rotating disk 50. Accordingly, balls 70A and 70B, after flexing into the holes via the resilience of the plastic disks 40 and 50, are retained in the dynamic orthotic device 20 rather than spilling out.

Figure 3:
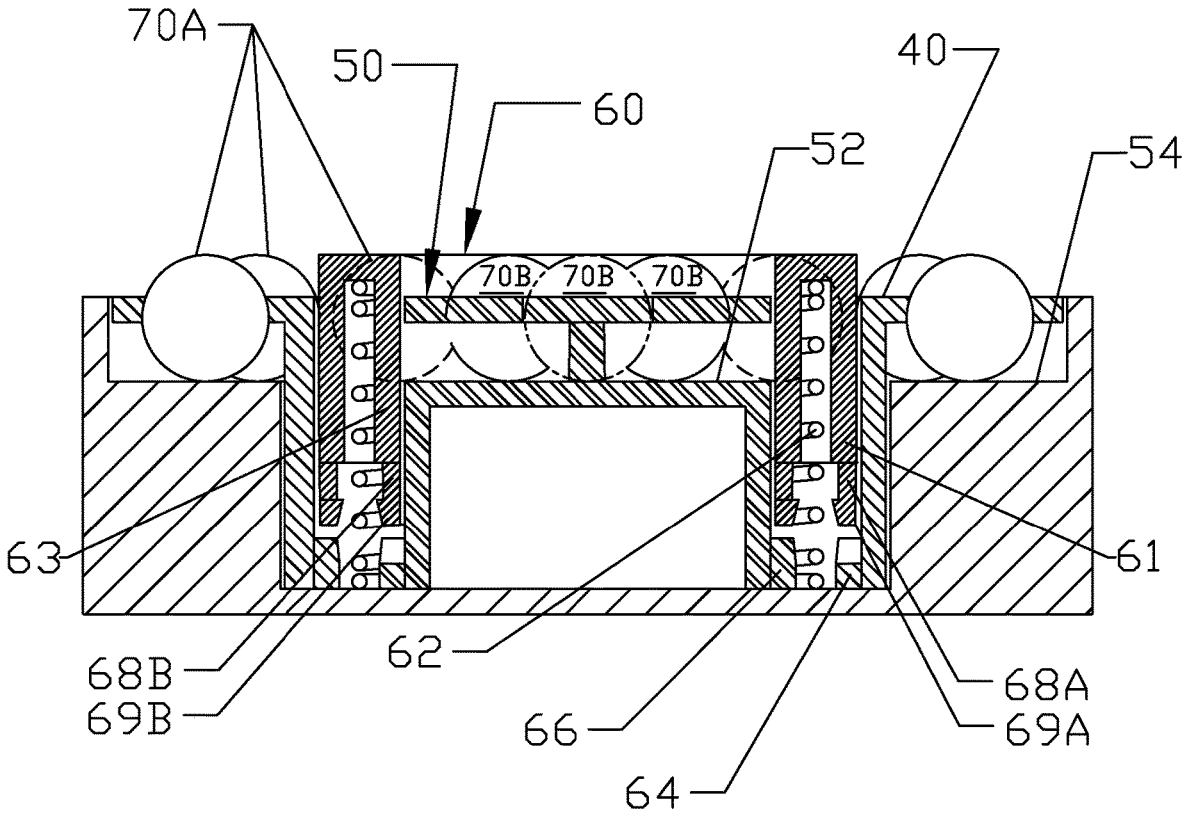
FIG. 3 is a cross-sectional side view of the first embodiment.
Figure 4:
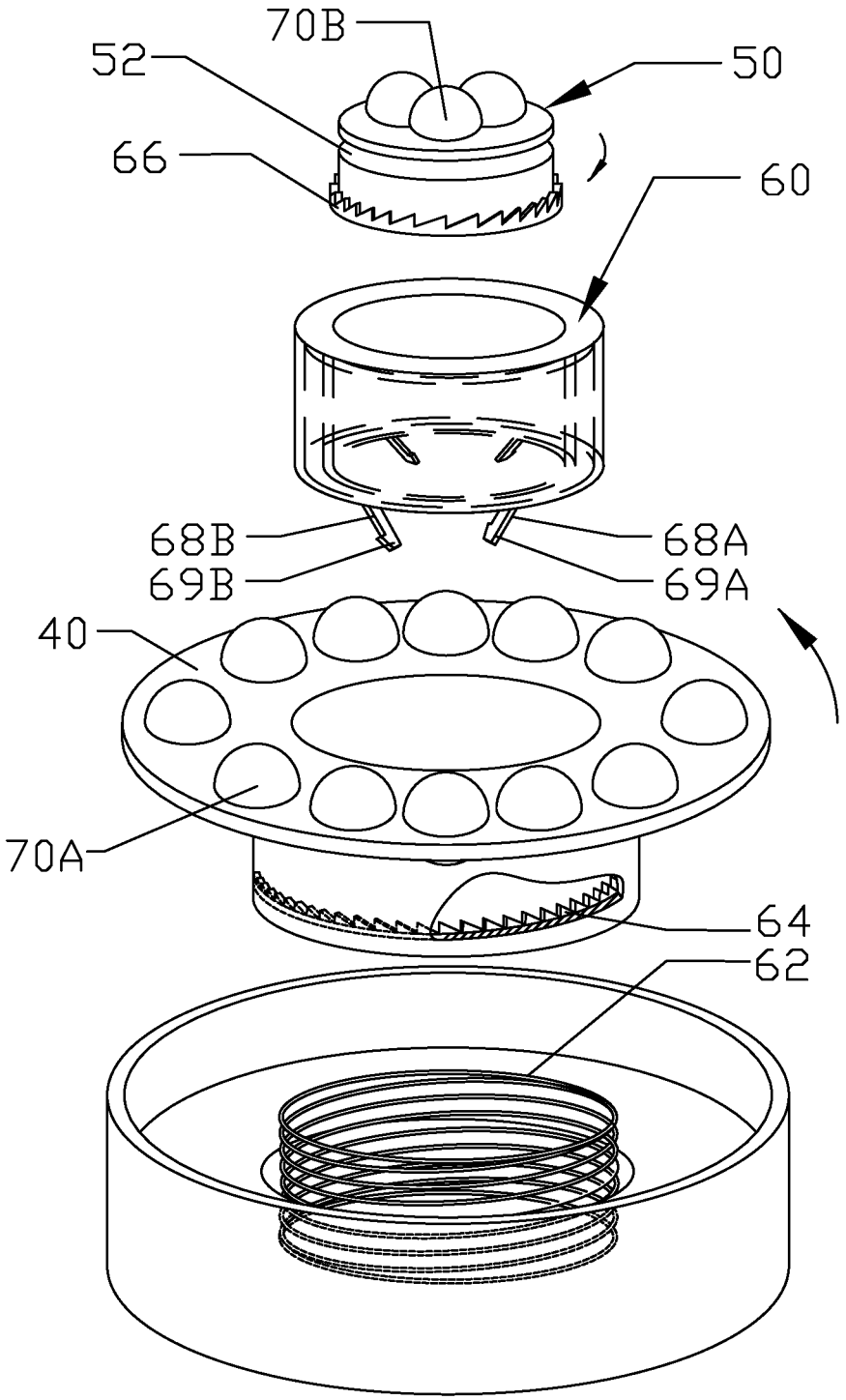
FIG. 4 an exploded front perspective view of the first embodiment.

As best seen in FIGS. 3 and 4, pushbutton 60 has an inverted U shape that accommodates spring 62 which, in turn biases pushbutton 60 upwardly. Outer gear-toothed member 64 is attached to outer rotating disk 40 while inner gear-toothed member 66 is attached to inner rotating disk 50. Two spring-biased arms 68A protrude downwardly from the outer wall 61 of U-shaped pushbutton 60, while two additional spring-biased arms 68B extend downwardly from the inner wall 63 of U-shaped pushbutton 60. It is to be noted the two arms 68A extend in the same direction and the two arms 68B extend in the same (but opposite) direction.

When the dynamic orthotic device 20 is inserted in a shoe, the heel of the wearer will compress pushbutton 60 compressing spring-biased arms 68A and 68B effectively extending them in opposite directions. The tines 69A and 69B at the ends of arms 68A and 68B will engage gear teeth of members 64 and 66 respectively. As the pressure exerted by the wearer's heel is reduced, spring-biased arms 68A and 68B will return to their at rest positions such that tines 69A and 69B will cause gear-toothed members 64 and 66 to rotate in clockwise and counter-clockwise directions, respectively. Massaging balls 70A and 70B will engage the soles of the wearer's feet in different locations with each step, effectively massaging the soles of the wearer's feet.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

We claim:

1. A dynamic orthotic device for massaging a heel portion of the soles of a wearer's feet, said dynamic orthotic device comprising:

a) a base member;

b) means to house a plurality of spherical balls beneath the heel portion of the sole of the wearer's foot, wherein said means to house a plurality of spherical balls comprises a first rotating disk having a first plurality of spherical ball-receiving holes and a second rotating disk having a second plurality of spherical ball-receiving holes;

c) a first means to rotate said means to house in a first rotational direction; and d) a second means to rotate said means to house in a second rotation direction;

wherein said first means to rotate rotates said first rotating disk in said first rotational direction and said second means to rotate rotates said second rotating disk in a second opposite rotational direction;

wherein each of said first and second means to rotate each includes a gear-toothed member associated with its respective rotating disk and a plurality of spring-biased arms which engage said gear-toothed member; and further comprising a spring-biased pushbutton configured to be engaged by a heel of the wearer, said spring-biased pushbutton mounting said pluralities of said spring-biased arms.

* * * * *